US009532698B2

(12) United States Patent
Heidel et al.

(10) Patent No.: US 9,532,698 B2
(45) Date of Patent: Jan. 3, 2017

(54) DISHWASHER WITH A SCREEN SYSTEM

(75) Inventors: Andreas Heidel, Holzheim (DE); Reinhard Hering, Holzheim (DE); Bernd Kränzle, Finningen (DE)

(73) Assignee: BSH Hausgeräte GmbH, Munich (DE)

( * ) Notice: Subject to any disclaimer, the term of this patent is extended or adjusted under 35 U.S.C. 154(b) by 1039 days.

(21) Appl. No.: 13/641,873

(22) PCT Filed: Apr. 7, 2011

(86) PCT No.: PCT/EP2011/055407
§ 371 (c)(1),
(2), (4) Date: Oct. 18, 2012

(87) PCT Pub. No.: WO2011/138118
PCT Pub. Date: Nov. 10, 2011

(65) Prior Publication Data

US 2013/0032171 A1 Feb. 7, 2013

(30) Foreign Application Priority Data

May 4, 2010 (DE) ..... 10 2010 028 567

(51) Int. Cl.
*A47L 15/00* (2006.01)
*A47L 15/42* (2006.01)

(52) U.S. Cl.
CPC ..... *A47L 15/0049* (2013.01); *A47L 15/4206* (2013.01); *A47L 15/4208* (2013.01);
(Continued)

(58) Field of Classification Search
None
See application file for complete search history.

(56) References Cited

U.S. PATENT DOCUMENTS

2003/0019510 A1* 1/2003 Hegeman et al. ..... 134/18
2003/0034052 A1* 2/2003 Kiesler ..... A47L 15/4244 134/18

(Continued)

FOREIGN PATENT DOCUMENTS

DE 10014871 A1 * 10/2001
EP 1464268 A2 * 10/2004

OTHER PUBLICATIONS

English Machine Translation of EP 1464268.*
English Machine Translation of DE 10014871.*
International Search Report PCT/EP2011/055407, Apr. 10, 2011

*Primary Examiner* — Nicole Blan
(74) *Attorney, Agent, or Firm* — Michael E. Tschupp; Andre Pallapies

(57) ABSTRACT

A dishwasher includes a controller controlling a cleaning cycle, a screen system for filtering a wash fluid, a circulation chamber and a collection chamber in fluid communication with the circulation chamber via a screen arrangement, a circulation pump for circulating the wash fluid and a drain pump for pumping out the wash fluid. During the cleaning cycle, to detect blockage in the screen arrangement, a degree of transmission in the circulation chamber filled with wash fluid is determined with an optical turbidity sensor in a first measuring step. The wash fluid is then pumped out of the collection chamber and the degree of transmission in the circulation chamber is again determined in a second measuring step. The change in the degree of transmission from the first measuring step to the second measuring step is then evaluated.

21 Claims, 4 Drawing Sheets

(52) U.S. Cl.
CPC ..... *A47L 15/4217* (2013.01); *A47L 15/4225* (2013.01); *A47L 2401/08* (2013.01); *A47L 2401/10* (2013.01); *A47L 2501/26* (2013.01); *A47L 2501/34* (2013.01)

(56) References Cited

U.S. PATENT DOCUMENTS

| | | | | |
|---|---|---|---|---|
| 2005/0051201 | A1 | 3/2005 | Ashton et al. | |
| 2006/0130878 | A1 | 6/2006 | Lee et al. | |
| 2007/0151579 | A1* | 7/2007 | Hooker et al. | 134/18 |
| 2007/0163626 | A1 | 7/2007 | Klein | |
| 2007/0181156 | A1 | 8/2007 | Uz et al. | |
| 2007/0251544 | A1 | 11/2007 | Elick et al. | |
| 2009/0032061 | A1* | 2/2009 | Beer | A47L 15/0002 134/18 |

* cited by examiner

DISHWASHER WITH A SCREEN SYSTEM

BACKGROUND OF THE INVENTION

The present invention relates to a dishwasher, in particular a household dishwasher, having a control facility for performing a wash cycle for cleaning items to be washed, having a screen system for filtering a wash fluid, which has a circulation chamber and a collection chamber, which communicates with the circulation chamber by way of a screen arrangement through which the wash fluid can flow, having a connector disposed on the circulation chamber for a circulation pump for circulating the wash fluid and having a connector disposed on the collection chamber for a drain pump for evacuating the wash fluid.

A dishwasher is known from practice, which has a screen system for filtering a wash fluid with a screen arrangement through which the wash fluid can flow.

If the screen arrangement is blocked, for example by dirt particles filtered out of the wash fluid, this can cause problems during operation of the dishwasher.

BRIEF SUMMARY OF THE INVENTION

The object of the present invention is to supply a dishwasher, in particular a household dishwasher, with improved operational reliability.

With a dishwasher of the type mentioned in the introduction the object is achieved in that the wash cycle comprises at least one detection sequence performed by the control facility to detect a blockage of the screen arrangement, with a first measuring step for determining a degree of transmission in the circulation chamber filled with wash fluid by means of an optical turbidity sensor being provided, with a first evacuation step for evacuating the wash fluid from the collection chamber being provided after the first measuring step, with a second measuring step for determining the degree of transmission in the circulation chamber by means of the optical turbidity sensor being provided after the first evacuation step and with a first evaluation step being provided for evaluating a change in the degree of transmission from the first measuring step to the second measuring step.

The inventive dishwasher has a control facility for the automatic performance of operating sequences of the dishwasher. To this end the control facility can be configured as a so-called sequence controller, in particular an electronic sequence controller.

Stored in the control facility is at least one wash program to perform or control a wash process, also referred to as a wash cycle, for washing items to be washed, in particular for washing tableware. A number of wash programs are advantageously provided here, one of which can be selected and started in each instance by the operator. This allows the sequence of a wash cycle to be tailored in particular to the load size, the load type, the degree of soiling of the items to be washed and/or the desired duration of the wash cycle.

The stored wash programs can preferably be configured in such a manner that the wash cycle controlled by them in each instance comprises in particular at least one prewash cycle for precleaning items to be washed, at least one cleaning cycle for the thorough cleaning of items being washed, at least one intermediate rinse cycle for removing soiled wash fluid from the items being washed, at least one final rinse cycle for preventing spots on the items being washed and/or as preparation for a drying step and/or at least one drying cycle for drying the items being washed. The prewash cycle, cleaning cycle, intermediate rinse cycle and final rinse cycle are referred to as water-conducting wash sub-cycles, since while they are being performed, the items to be washed that have been introduced into the wash chamber are treated with a wash fluid. There is generally no provision for the use of wash fluid during the drying cycle.

The treatment of the items being washed with wash fluid takes place here in an essentially closed wash chamber, in particular a wash container, of the dishwasher. An intake valve can be assigned to the wash chamber here, allowing wash fluid to be introduced into the wash chamber. The intake valve can be opened and closed by the control facility, in order thus to influence the intake of wash fluid.

A wash fluid here refers in particular to a fluid provided to be applied to the items to be washed, in order to clean and/or otherwise treat them. The wash fluid can thus also be provided for example to heat the items being washed, which is normal for example during a final rinse step.

The wash fluid entering the wash chamber by way of the intake valve is generally intake water. The wash fluid in the wash chamber can contain cleaning agents, cleaning aids, for example rinse aid, and/or dirt, which has been detached from the items being washed, depending on the operating phase of the dishwasher. However instances are also conceivable, in which water already containing added agents is introduced into the wash chamber as wash fluid by way of the intake valve.

In order to clean dirt particles from the wash fluid in particular during a wash cycle, a screen system with a circulation chamber and a collection chamber is provided, which can be disposed in particular on a base of the wash chamber, also referred to as the base sump, so that the wash fluid present in the wash chamber flows automatically to the screen system due to the force of its own weight. The circulation chamber and the collection chamber are separated from one another by a screen arrangement, through which the wash fluid to be filtered can flow. This allows an exchange of wash fluid without disrupting operation of the dishwasher, so that an essentially identical fill level of wash fluid is established automatically in both chambers. If for example wash fluid is removed from the circulation chamber by way of the connector of the circulation chamber, so that the fill level of wash fluid in the circulation chamber drops, the force of its own weight causes wash fluid to flow from the collection chamber through the screen arrangement into the circulation chamber, so that the fill levels in the circulation chamber and the collection chamber are equalized. Conversely, if for example wash fluid is removed from the collection chamber by way of the connector of the collection chamber, wash fluid flows from the circulation chamber through the screen arrangement into the collection chamber. Such an arrangement of the circulation chamber and the collection chamber, in which fill levels are equalized by the force of weight, is also referred to as a communicating arrangement.

The screen arrangement separating the circulation chamber and the collection chamber can consist of one or more screens. The normal screen arrangement for example has an upright cylindrical fine screen and outside it a concentrically disposed cylindrical micro-screen. The micro-screen here is provided to remove micro-particles of dirt from the wash liquor. The use of a fine screen allows the wash liquor to be precleaned. Finer micro-particles of dirt that have passed through the fine screen can then be at least partially retained by the micro-screen. The two-stage embodiment of the screen arrangement allows the tendency of the screen arrangement to become blocked to be reduced in principle but not always excluded.

The connector of the circulation chamber is typically connected to an electrically driven circulation pump for circulating the introduced wash fluid, allowing the wash fluid present in the circulation chamber to be removed and applied to the items being washed by way of a spray system assigned to the wash chamber. Similarly the connector of the collection chamber can be connected to a generally electrically driven drain pump for evacuating the introduced wash fluid to the outside, also referred to as a waste water pump. It is however also conceivable for the connector of the circulation chamber and the connector of the collection chamber to be connected in turn by way of a valve arrangement, water switch or the like to such a pump, which takes on either the function of the circulation pump or the function of the drain pump, depending on the valve arrangement circuit.

Like the drain pump the circulation pump can preferably comprise a brushless electric motor. The brushless electric motor can be configured in particular as a permanent magnet motor. Such a brushless permanent magnet motor can be configured for example as a brushless direct current motor, or BLDC motor, or as a brushless alternating current motor, or BLAC motor. The rotor of the motor here comprises at least one permanent magnet, while the stator has a number of electromagnets. The electromagnets here are commutated by way of an electronic activation system, in particular by way of a frequency inverter. Compared with other possible motor designs it is possible here to control both the direction of rotation and the speed of the motor in a simple manner. By operating the motor in just one direction of rotation, it is possible to optimize the water-conducting parts of the circulation pump and the drain pump respectively in respect of flow. This means that a high delivery can be achieved with a low energy input. Also the brushless permanent magnet motor can be configured as a wet rotor, thereby dispensing with the need for complex sealing measures.

The inventive dishwasher is configured in such a manner that the control facility performs at least one detection sequence for detecting a blockage of the screen arrangement during the wash cycle. In this process, for example at the end of a water-conducting wash sub-cycle, when the circulation chamber is filled with wash fluid, a first measuring step is performed, in which an optical turbidity sensor is used to determine a degree of transmission in the circulation chamber.

The turbidity sensor generally comprises a light source, for example a light-emitting diode, and a light receiver, for example a phototransistor, which are disposed in such a manner that light emitted by the light-emitting diode passes through the medium present at the time in the circulation chamber, in other words generally wash fluid or air, before striking the light receiver. The turbidity sensor here is configured to determine the degree of transmission of the medium, in other words to determine the ratio of the intensity of the received light to the intensity of the emitted light, the intensity being the power of the light per unit of area. However in the context of the present application the term "determine the degree of transmission" also refers to the determination of such variables as contain the same technical information in a different formulation. This includes in particular the determination of the so-called opacity, in other words the determination of the inverse of the degree of transmission defined above, or the determination of the so-called extinction, which is a logarithmic formulation of opacity.

Provision is also made in the context of the detection sequence after the first measuring step for a first evacuation step for evacuating the wash fluid by way of the connector of the collection chamber. If the screen arrangement is not blocked, this also evacuates the wash fluid present in the circulation chamber, so that after the evacuation step the circulation chamber is essentially full of air. However if there is a blockage present, at least some of said wash fluid remains in the circulation chamber.

Provision is made after the first evacuation step for a second measuring step for a new determination of the degree of transmission in the circulation chamber by means of the optical turbidity sensor. A first evaluation step that now follows for evaluating a change in the degree of transmission from the first measuring step to the second measuring step now allows a conclusion to be drawn as to whether sufficient wash fluid has been evacuated from the circulation chamber by the first evacuation step, as the degree of transmission changes significantly during the transition of the metered medium from fluid to air. This in turn allows a conclusion to be drawn as to whether or not the filter arrangement is blocked.

It is thus possible, after an evacuation process during the wash cycle, for example at the end of a water-conducting wash sub-cycle, to prevent a generally soiled residual quantity of wash fluid remaining in the screen arrangement undetected, which would have an adverse effect on the wash result of the wash cycle or a subsequent wash cycle. The detection of a blockage therefore allows the institution of corresponding countermeasures. This improves the operational reliability of the inventive dishwasher.

Detection accuracy here is higher than with detection sequences in which the degree of soiling of the wash fluid, in other words its turbidity, is ascertained on the basis of the degree of transmission and when a defined degree of soiling is reached, it is concluded that there is a blockage, as a high level of turbidity, in particular due to a large number of fine dirt particles, does not necessarily result in a blockage. This can lead to a large number of incorrect detection results with such detection sequences.

Detection accuracy is also higher than with detection sequences in which the circulation pump is activated after the evacuation step without measuring the degree of transmission and its power consumption is compared with a threshold value, with the exceeding of the threshold value being interpreted as a blockage. It is true that a high power consumption indicates an undesirably high fill level of wash fluid in the circulation chamber but a defined threshold value can also be exceeded, when the fill level is not too high and there is no blockage present. This can be due for example to the serial deviation of the circulation pump and/or the ageing of the circulation pump, which can produce many incorrect detection results.

The requirements for the structural embodiment of the dishwasher are also minor. In many instances the necessary structural features are already present, so the invention can be implemented by corresponding adjustment of the control facility.

According to one advantageous development of the invention, if a decrease in the degree of transmission of at least a first minimum value is present, the detection sequence is terminated. Termination of the detection sequence here refers to an ending of the same, when a blockage of the screen arrangement is deemed to be excluded. The degree of transmission is 30% greater in clear wash fluid than in air. Also the degree of transmission in soiled wash fluid is generally in a range around 30% to 10% greater than in air, depending on the degree of soiling. If there is a decrease of around a suitably defined minimum value, it can be reliably excluded that the decrease in the degree of transmission is due to additional and sudden soiling of the wash fluid. It is therefore then extremely likely that during the first evacuation step a transition has taken place from wash fluid to air, which ultimately means that the filter arrangement is very certainly not blocked. Incorrect detection of blockages can thus be reliably avoided. For example a decrease of at least 10% can be provided as the first minimum value.

According to one advantageous development of the invention the first evacuation step comprises a load detection step for determining a power consumption of the drain pump, with the detection sequence being terminated, if the power consumption is greater than a threshold value provided for the drain pump. If a suitably defined threshold value is exceeded, this indicates that there is still wash fluid in the collection chamber after the end of the evacuation step. The wash fluid present in the circulation chamber before the first evacuation step can then not be discharged even if the screen arrangement is clear, so that incorrect detection of a blockage would occur if the detection sequence continued. This can be prevented by terminating the detection sequence.

According to one advantageous development of the invention, if the detection sequence is terminated during the load detection sequence for determining the power consumption of the drain pump, an error processing sequence for processing a malfunction of a discharge facility disposed downstream of the drain pump is provided. If there is still wash fluid present in the collection chamber after the first evacuation step, this is generally due to a malfunction of a discharge facility disposed downstream of the drain pump. By initiating a corresponding error processing sequence it is now possible to prevent the malfunction remaining undetected. In particular the error processing sequence can comprise the outputting of a warning message to an operator.

According to one expedient development of the invention a load detection step for determining a power consumption of the circulation pump is provided between the first evacuation step and the second measuring step, with the detection sequence being terminated, if the power consumption is lower than a threshold value provided for the circulation pump. A power consumption below a suitably defined threshold value indicates with high probability that the circulation chamber has been adequately emptied after the first evacuation step, so it can be concluded that the filter arrangement is clear. Termination of the detection sequence in this instance simplifies the progress of the wash cycle without impacting on the reliability of blockage detection. If the defined threshold value is exceeded, even though the fill level is not too high and there is no blockage present, this is detected in the following first evaluation step, so that incorrect detection of a blockage is excluded.

According to one expedient development of the invention a first waiting step is provided between the first evacuation step and the load detection step for determining the power consumption of the circulation pump. This prevents incorrect determination of the power consumption of the circulation pump due to transient phenomena, further improving detection reliability.

According to one expedient development of the invention, if the detection sequence is terminated during the load detection step for determining the power consumption of the circulation pump, after the load detection step for determining the power consumption of the circulation pump an adjustment step is provided for redetermining the threshold value provided for the circulation pump, in which the power consumption of the circulation pump is measured and a new threshold value is determined from the measured power consumption. In this instance the power consumption of the circulation pump is measured when the circulation chamber is empty. This allows a change in the power consumption of the circulation pump when running dry, in other words when it is not conveying wash fluid, as caused by ageing phenomena, to be taken into account when the detection sequence is performed later. The threshold value can be redetermined for example by adding together the measured power consumption and a safety margin. It is also possible to multiply the measured power consumption by a safety factor.

According to one expedient development of the invention a second evacuation step for evacuating the wash fluid by way of the connector of the collection chamber is provided between the load detection step for determining the power consumption of the circulation pump and the adjustment step. This prevents any falsification of the measurement of the power consumption of the circulation pump when running dry due to residual water, thereby improving the accuracy of the new threshold value.

According to one advantageous development of the invention a third evacuation step for evacuating the wash fluid by way of the connector of the collection chamber is provided between the load detection step for determining the power consumption of the circulation pump and the second measuring step. This prevents any falsification of the measurement of the degree of transmission in the second measuring step due to residual water collecting during the load detection step, thereby improving the accuracy of determination of the degree of transmission and therefore detection reliability.

According to one advantageous development of the invention a second waiting step is provided between the load detection step for determining the power consumption of the circulation pump and the third evacuation step. This in particular prevents any falsification of the determination of the degree of transmission in the second measuring step due to foam formation in the load detection step, thereby further improving detection reliability.

According to one advantageous development of the invention, if the decrease in the degree of transmission determined in the first evaluation step is lower than the first minimum value, after the second measuring step a wash fluid supplementing step is provided, in which an additional quantity of wash fluid is fed to the screen system, with a third measuring step for determining the degree of transmission in the circulation chamber by means of the optical turbidity sensor being provided after the wash fluid supplementing step, with a second evaluation step for evaluating a change in the degree of transmission from the second measuring step to the third measuring step being provided, with the detection sequence being terminated, if an increase in the degree of transmission of at least a second minimum value is present.

If the decrease in the degree of transmission determined in the first evaluation step is lower than the first minimum value, this may be because either the wash fluid has not drained out of the circulation chamber during the first and third evacuation steps, which would be interpreted as a blockage of the screen arrangement, or the wash fluid was so soiled during the first measuring step that, because of its low degree of transmission, the first minimum value, in other words the minimum decrease from the first measured degree of transmission to the second measured degree of transmission, is not reached, despite a transition from wash fluid to air, which would be interpreted as an absence of blockage. In order to distinguish between these two instances, an additional quantity of the clearest wash fluid possible is fed to the screen system. Intake water can be fed in for this purpose for example by way of the intake valve. A third measuring step for determining the degree of transmission is now performed and the degree of transmission measured in this process is compared with the degree of transmission of the second measuring step. If a minimum increase of for example 10% results, it can be concluded that there was no wash fluid present in the circulation chamber in the second measuring step, clearly indicating that the screen arrangement is not blocked. The detection sequence can then be terminated.

According to one expedient development of the invention, if the detection sequence is terminated during the first evaluation step, after the first evaluation step an adjustment step for redetermining the threshold value provided for the circulation pump is provided, in which the power consumption of the circulation pump is measured and a new threshold value is determined from the measured power consumption. The power consumption of the circulation pump is measured when the circulation chamber is empty in this instance too. This allows a change in the power consumption of the circulation pump when running dry, in other words when it is not conveying wash fluid, as caused by ageing phenomena, to be taken into account when the detection sequence is performed later. The threshold value can also be redetermined for example by adding together the measured power consumption and a safety margin. It is also possible to multiply the measured power consumption by a safety factor.

According to one advantageous development of the invention, if the increase in the degree of transmission determined in the second evaluation step is lower than the second minimum value, after the second evaluation step a fourth evacuation step for evacuating the wash fluid by way of the connector of the collection chamber is provided, with a fourth measuring step for determining the degree of transmission in the circulation chamber by means of the optical turbidity sensor being provided after the third evacuation step and with a third evaluation step for evaluating a change in the degree of transmission from the third measuring step to the fourth measuring step being provided, with the detection sequence being terminated, if a decrease in the degree of transmission of at least a third minimum value is present. If the increase in the degree of transmission determined in the second evaluation step is lower than the second minimum value, this may be because either the wash fluid has not drained out of the circulation chamber during the first and third evacuation steps, which would be interpreted as a blockage of the screen arrangement, or the wash fluid fed in during the wash fluid supplementing step was so soiled that, because of its low degree of transmission, the second minimum value, in other words the minimum increase from the second measured degree of transmission to the third measured degree of transmission is not reached, despite a transition from air to wash fluid, which would be interpreted as an absence of blockage. In order to distinguish between these two instances a fourth evacuation step and a fourth measuring step for determining the degree of transmission are performed. The decrease from the third degree of transmission to the fourth degree of transmission is then determined. This result may be different from the result of the first evaluation step, since at the start of the third measuring step clearer wash fluid is generally present in the circulation chamber than in the first measuring step, due to the wash fluid supplementing step. If a minimum decrease of for example 7% now results, it can be concluded that no wash fluid was present in the circulation chamber in the fourth measuring step, which clearly indicates that the screen arrangement is not blocked. The detection sequence can then be terminated.

According to one advantageous development of the invention in the third evaluation step a decrease in the degree of transmission of less than the third minimum value is interpreted as a blockage of the screen arrangement, with the control facility initiating an automatic cleaning sequence and/or warning message. Incorrect detection is pretty much excluded when a blockage of the screen arrangement is detected in this manner. It is advantageous here for an automatic sequence for eliminating the blockage to be provided. Similarly an automatic sequence can be output to output a warning message, so that an operator can eliminate the blockage manually.

The invention further relates to a method for operating a dishwasher, in particular as claimed in one of the preceding claims, having a control facility for performing a wash cycle for cleaning items to be washed, having a screen system for filtering a wash fluid, which has a circulation chamber and a collection chamber, which communicates with the circulation chamber by way of a screen arrangement through which the wash fluid can flow, having a connector disposed on the circulation chamber for a circulation pump for circulating the wash fluid and having a connector disposed on the collection chamber for a drain pump for evacuating the wash fluid.

With the inventive method provision is made during the wash cycle for the control facility to perform at least one detection sequence for detecting a blockage of the screen arrangement, with a first measuring step for determining a degree of transmission in the circulation chamber filled with wash fluid by means of an optical turbidity sensor being provided, with a first evacuation step for evacuating the wash fluid by way of the connector of the collection chamber being provided after the first measuring step, with a second measuring step for determining the degree of transmission in the circulation chamber by means of the optical turbidity sensor being provided after the first evacuation step and with a first evaluation step for evaluating a change in the degree of transmission from the first measuring step to the second measuring step being provided.

The inventive method allows simple, fast and reliable detection of a blockage of the screen arrangement and is characterized by minor requirements in respect of the structural embodiment of the dishwasher.

Other advantageous configurations and/or developments of the invention are set out in the claims.

The advantageous developments of the invention set out in the dependent claims and/or described above can be provided individually or in any combination with one another.

BRIEF DESCRIPTION OF THE DRAWINGS

The invention and its developments as well as their advantages are described in more detail below with reference to figures, in which.

DETAILED DESCRIPTION OF EXEMPLARY EMBODIMENTS OF THE PRESENT INVENTION

Figure 1:
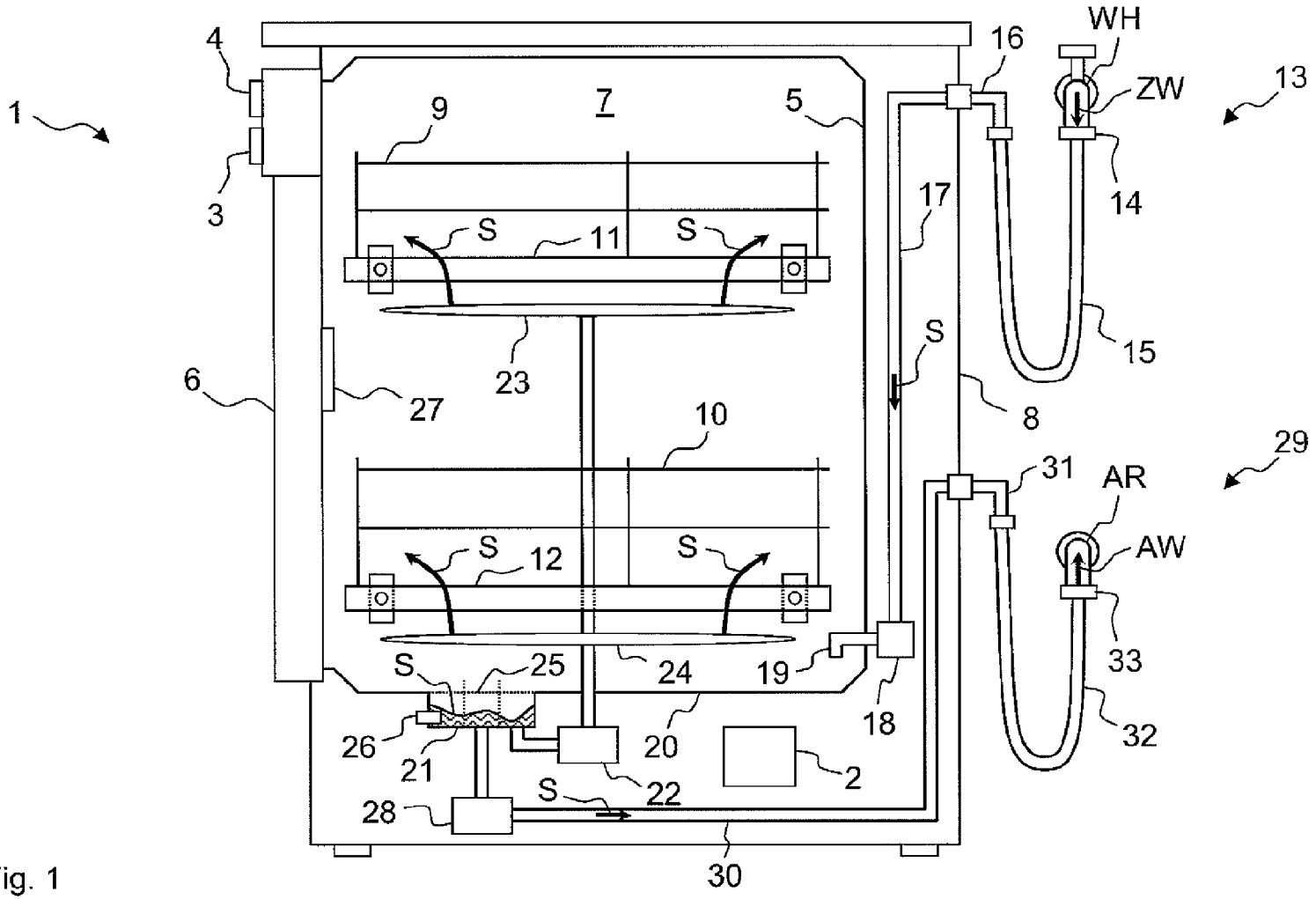
FIG. 1 shows a schematic side view of an exemplary embodiment of an inventive household dishwasher.

In the figures which follow corresponding parts are shown with the same reference characters. Only the components of a dishwasher that are necessary for an understanding of the invention are provided with reference characters and described. It goes without saying that the inventive dishwasher can comprise further parts and assemblies.

FIG. 1 shows a schematic side view of an advantageous exemplary embodiment of an inventive household dishwasher 1. The dishwasher 1 has a control facility 2, in which at least one wash program for controlling a wash cycle for washing items to be washed, in particular tableware, is stored. A number of wash programs are expediently stored, so that it is possible, by selected a suitable wash program, to tailor the sequence of a wash cycle controlled by the control facility 2 for example to the load size, the load type, the degree of soiling of the items to be washed and/or the desired duration of the wash cycle.

The control facility 2 is assigned an operating facility 3, which allows an operator of the dishwasher 1 to call up and start one of the wash programs. The control facility 2 is also assigned an output facility 4, which allows the outputting of messages to the operator. The output facility 4 can comprise display lamps, light-emitting diodes, an alphanumeric display and/or a graphical display for the outputting of optical messages. The output facility 4 can also have a buzzer, loudspeaker and/or the like for outputting acoustic messages.

The dishwasher 1 further comprises a wash container 5, which can be closed off by a door 6, so that a closed wash chamber 7 for washing items to be washed results. The wash container 5 can optionally be disposed in the interior of a housing 8 of the dishwasher 1. In the case of integrated dishwashers the housing 8 is not required and in some instances can be completely dispensed with at the top. FIG. 1 shows the door 6 in its closed position. The door can be moved into an open position by pivoting about an axis disposed perpendicular to the plane of the drawing, being aligned essentially horizontally in said open position to allow the introduction and removal of items being washed. In the exemplary embodiment illustrated in FIG. 1 the operating facility 3 is disposed in a user-friendly manner on an upper segment of the door 6. The output facility 4 is likewise disposed on the upper segment of the door 6, so that optical messages can be seen clearly and acoustic messages can be heard easily. In principle however it is possible to dispose the operating facility 3 and/or the output facility 4 in a different place.

The control facility 2 is accommodated for example in a base assembly below the wash container 5. However it is also possible to dispose the control facility 2 in a different place in the dishwasher 1. However the control facility 2 could also be configured in a decentralized manner, in other words it could comprise spatially separated components which are connected by way of communication means so that they can interact.

According to one alternative variant the control facility 2 or at least one of its decentralized components can be positioned in the door 6, so that the necessary signal connections between the operating facility 3, the output facility 4 and the control facility 2 can be kept short.

For positioning tableware the dishwasher 1 has an upper rack 9 and a lower rack 10. The upper rack 9 is disposed on pull-out rails 11, which are fastened in each instance to opposing side walls of the wash container 5 extending in the depthwise direction of said wash container. When the door 6 is open, the rack 9 can be moved out of the wash container 5 by means of the pull-out rails 11, to facilitate the loading and unloading of the upper rack 9. The lower rack 10 is similarly disposed on pull-out rails 12.

The wash program(s) stored in the control facility 2 can each provide a number of wash sub-cycles, for example in this order at least one prewash cycle, at least one cleaning cycle, at least one intermediate rinse cycle, at least one final rinse cycle and/or at least one drying cycle. The prewash cycle, cleaning cycle, intermediate rinse cycle and final rinse cycle are referred to as water-conducting wash sub-cycles, since while they are being performed, the items to be washed that have been positioned in the wash chamber 7 are treated with a wash fluid S. There is generally no provision for treating the items being washed with wash fluid S during the drying cycle.

In the exemplary embodiment fresh water or intake water ZW is used as the wash fluid S for treating the items being washed, being able to be drawn from an external water supply facility WH, in particular an external drinking water supply network, and introduced into the wash chamber 7. At the start of each water-conducting wash sub-cycle a wash fluid S formed from fresh intake water ZW is typically introduced, which is then output at the end of the respective wash sub-cycle as waste water AW to an external waste water disposal facility AR. It is however also possible to store wash fluid S from a wash sub-cycle in a storage container (not shown) and introduce it back into the wash chamber 7 in a later wash sub-cycle.

The dishwasher 1 in FIG. 1 comprises a water intake facility 13, which is provided for connection to the external water supply facility WH. As in FIG. 1, the external water supply facility WH can be a faucet of a water installation in the building, which supplies pressurized intake water ZW. The water intake facility 13 comprises a connecting piece 14, which is provided for connection to the faucet WH. The connection can be achieved for example by way of a thread arrangement, a bayonet arrangement or the like. Provided downstream of the connecting piece 14 is a connecting hose 15, which is preferably configured as flexible. The downstream end of the connecting hose 15 is connected to a connecting piece 16 that is fixed to the housing.

Provided downstream of the connecting piece 16 fixed to the housing is a supply line 17, which is connected to an input side of an intake valve 18 that can be switched by means of the control facility 2. An output side of the intake valve 18 is in turn connected to a fluid inlet 19 of the wash chamber 7. This allows intake water ZW to be directed as wash fluid S into the interior of the wash chamber 7 of the dishwasher 1 by means of the water intake facility 13. The intake valve 18 here can be configured as a switchable solenoid valve, which only has an open position and a closed position. A water processing system (not shown), for example a softening system, can be provided in the supply line 17.

Instead of or in addition to the intake valve 18 on the appliance, an external intake valve, in particular a so-called aqua-stop valve can also be provided between the connecting piece 14 and the faucet WH, preferably being able to be switched, in particular blocked or opened, by means of the control facility.

The wash fluid S entering the wash chamber 7 by way of the fluid inlet 19 passes into a collection facility 21, which can preferably be configured as a collection pot 21, configured on a base 20 of the wash container 5 due to the force of its weight. An input side of a circulation pump 22 is connected in a fluid-conducting manner to the collection pot 21. An output side of the circulation pump 22 is also connected to a spray facility 23, 24, which allows wash fluid S to be applied to the items to be washed that have been introduced into the wash chamber 7.

In the exemplary embodiment the circulation pump 22 has a brushless alternating current motor, or BLAC motor. However other motor designs would also be conceivable.

In the exemplary embodiment in FIG. 1 the spray facility 23, 24 comprises an upper rotatable spray arm 23 and a lower rotatable spray arm 24. However fixed spray elements can also be provided alternatively or additionally.

The wash fluid S exiting from the spray facility 23, 24 when the circulation pump 22 is activated passes back into the collection pot 21 within the wash chamber 7 due to the force of its own weight. In order to be able to clean the wash fluid S of dirt particles in particular during a wash cycle, a screen system 25 is provided in the region of the collection pot 21, to which an optical turbidity sensor 26 is assigned. The turbidity sensor 26 can in particular be used to determine the degree of soiling of the wash fluid S, it being possible to tailor a wash cycle to the determined degree of soiling. Likewise the turbidity sensor 26 can be used to monitor the functionality of the screen system, as described in more detail below.

The dishwasher 1 also has a dosing facility 27 in the conventional manner, allowing it to add cleaning agents and/or cleaning aids to the wash fluid S introduced into the wash chamber 7, to improve the cleaning action and/or drying action of a wash cycle.

The dishwasher 1 illustrated in FIG. 1 also has a drain pump 28, which serves to evacuate wash fluid S that is no longer needed from the wash chamber 7. In the exemplary embodiment the drain pump 28, like the circulation pump 22, has a brushless alternating current motor, or BLAC motor. However other motor designs would also be conceivable here.

The input side of the drain pump 28 is connected to the collection pot 21 and the output side of the drain pump 28 is connected to a discharge facility 29. The discharge facility 29 here serves to discharge the evacuated wash fluid S to the outside as waste water AW.

The discharge facility 29 comprises a connecting line 30, the downstream end of which is connected to a connector 31 of the dishwasher 1, which is fixed to the housing. Fastened to an output of the connector 31 fixed to the housing is a waste water hose 32, which is configured as flexible. Disposed on the downstream end of the waste water hose 32 is a connecting piece 33, which is provided to connect the discharge facility 29 to a waste water disposal facility AR. The waste water disposal facility AR can be a waste water pipe of a water installation in the building. The connection between the connecting piece 33 and the waste water pipe can be configured as a screw connection, a bayonet connection, a plug-type connection or the like.

Figure 2:
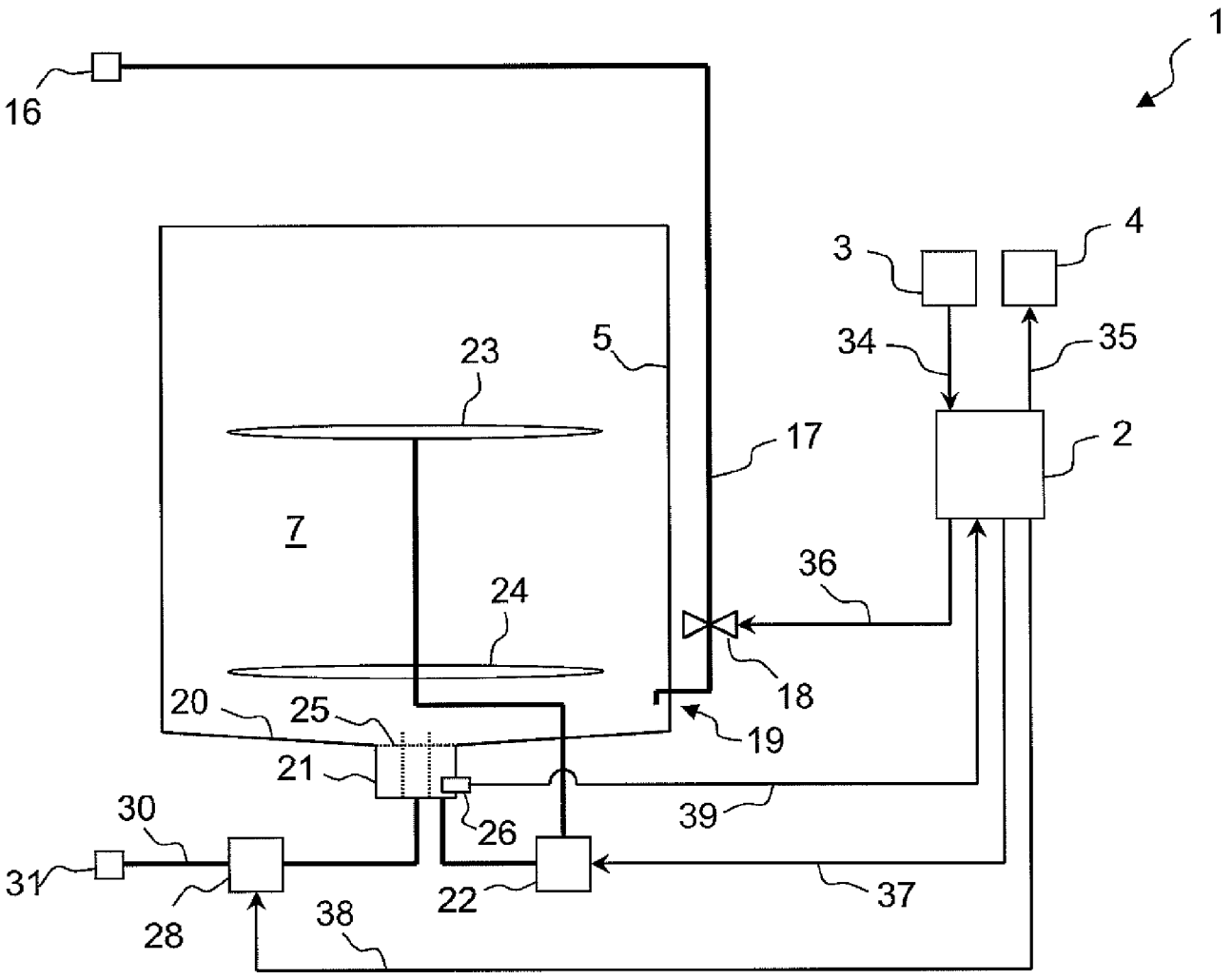
FIG. 2 shows a further view of the dishwasher in FIG. 1.

FIG. 2 shows a block diagram of the household dishwasher 1 in FIG. 1, with particular emphasis on the control and communication design. In the exemplary embodiment a signal line 34 is provided, which connects the operating facility 3 to the control facility 2 in such a manner that operating commands from an operator can be transmitted from the operating facility 3 to the control facility 2. A signal line 35 is also provided, which connects the control facility 2 to the output facility 4, so that information supplied by the control facility 2 can be transmitted to the output facility 4 and can be output there to the operator.

A control line 36 is also provided, which connects the control facility 2 to the switchable intake valve 18 in such a manner that the intake valve 18 can be closed and opened respectively by the control facility 2. This allows the introduction of wash fluid S into the wash chamber 7 to be controlled by the control facility 2.

A supply line 37 connects the control facility 2 to the circulation pump 22. This means that the circulation pump 22 can also be switched by the control facility 2. The control facility 2 is configured to activate or deactivate the circulation pump 22 and in particular to control and/or regulate the speed of the circulation pump 22. A supply line 38 is also provided, which connects the control facility 2 to the drain pump 28, so that the drain pump 28 can also be switched, in particular deactivated and activated, by the control facility 2. The speed of the drain pump 28 can also be controlled and/or regulated by the control facility 2.

A signal line 39 also connects the turbidity sensor 26 to the control facility 2, so that its measurement values can be transmitted to the control facility 2 and can be used by the control facility 2, in particular when performing a wash cycle, to influence said wash cycle.

Figure 3:
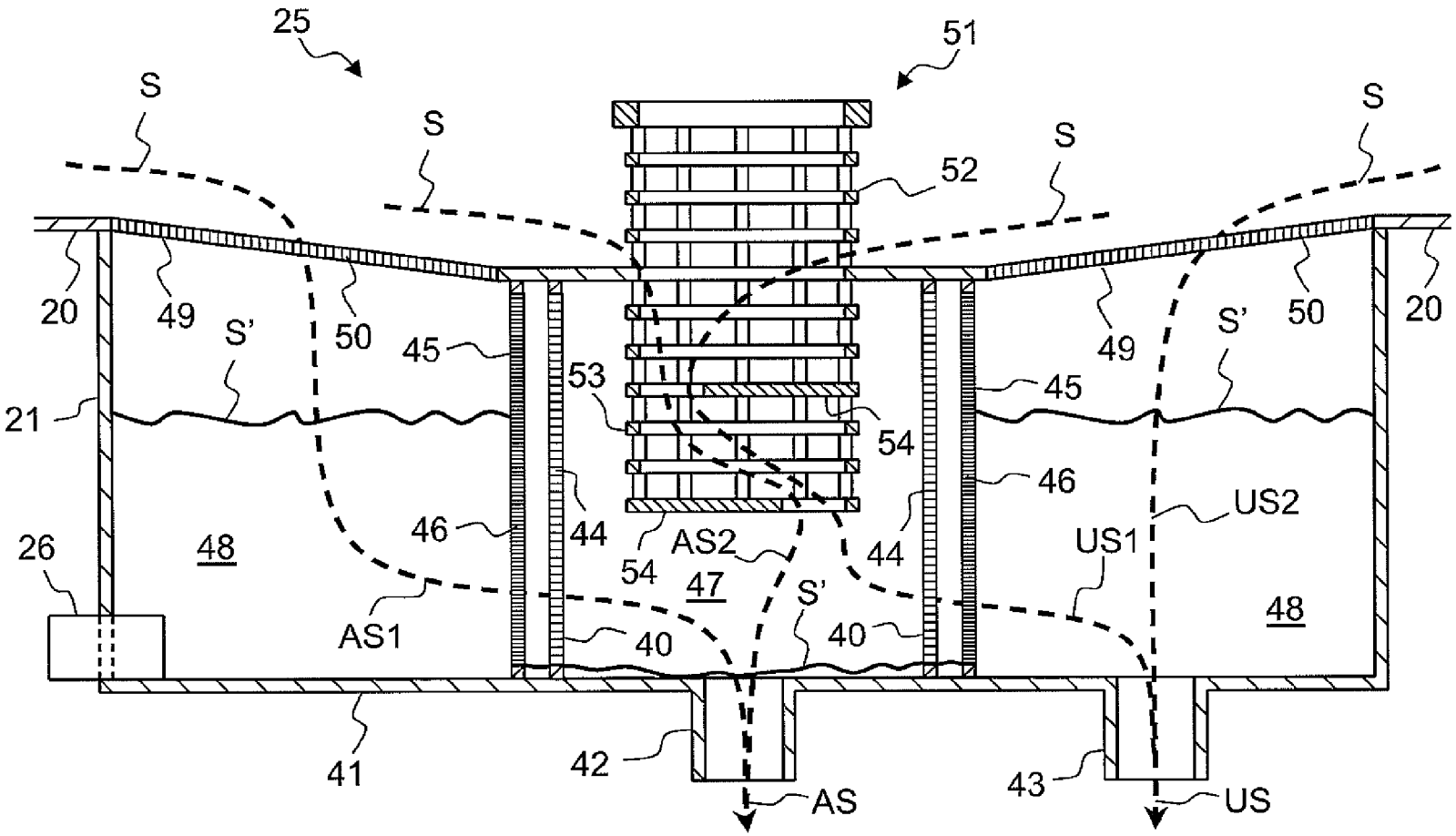
FIG. 3 shows an enlarged view of the screen system of the household dishwasher in FIGS. 1 and 2.

FIG. 3 shows a detailed view of the inventive dishwasher in FIG. 1. The collection pot 21 let into the base 20 of the wash container and the screen system 25 are shown here in a sectional view.

The screen system 25 has a first fine screen 40, which is configured as cylindrical, its axis being disposed upright. The lower face of the cylindrical fine screen 40 rests on the upper face of the base 41 of the collection pot 21. The cylindrical fine screen 40 extends to the upper face of the screen system 25.

Provided in the base 41 of the collection pot 21 is a connector 42, which is configured as a connecting stud 42 and is connected by way of a hose or the like to the drain pump 28. The connecting stud 42 is disposed in a region of the base 41, which is enclosed by the fine screen cylinder 40. Provided away from said region in the base 41 is a further connector 43, which is configured as a connecting stud 43 and is connected by way of a hose or similar means (not shown) to the circulation pump 22.

The fine screen 40 has through openings 44, through which wash fluid S can pass. The through openings here are dimensioned so that coarser dirt particles in the wash fluid S are retained. During a circulation operation, in which the circulation pump 22 of the dishwasher 1 is activated, a circulating flow US of wash fluid S is produced, of which a first sub-flow US1 exits radially outward from the interior of the cylindrical fine screen 40. At least some of the fine dirt contained in the wash fluid S is retained in the interior of the cylindrical fine screen 40 in this manner. Some of said dirt drops onto the base 41 of the collection pot 21 and some of said dirt adheres to the inner face of the cylindrical fine screen 40. In order to be able to clean the wash fluid S more thoroughly, a micro-screen 45 is provided, which is likewise configured as cylindrical and is disposed concentrically around the fine screen 40. Dirt contained in the first sub-flow US1, which can pass through the fine screen 40, is deposited on the inner face of the micro-screen cylinder 45, as its through openings 46 are smaller.

An equally possible removal of dirt from the screen system 25 takes place in an evacuation phase, in which activation of the drain pump 28 produces an evacuation flow AS, to evacuate the wash fluid S to the outside. A first sub-flow AS1 of the evacuation flow AS is guided through the cylindrical micro-screen 45 and the cylindrical fine screen 40, its direction of passage being counter to the direction of passage of the first sub-flow US1 of the circulation flow US. This detaches dirt particles adhering to the inner face of the cylindrical micro-screen 45 and to the inner face of the fine screen cylinder 40, so that they are discharged to the outside by means of the evacuation pump AS, in the same manner as the dirt particles lying on the base 41 of the collection pot 21.

The space enclosed by the fine screen cylinder 40 is also referred to as the collection chamber 47. The volume in the collection pot 21 outside the micro-screen cylinder 45 is also referred to as the circulation chamber 48. The circulation chamber 48 and the collection chamber 47 are separated from one another by a screen arrangement 40, 45 formed by the fine screen cylinder 40 and the micro-screen cylinder 45, through which the wash fluid S to be filtered can flow. This allows an exchange of wash fluid S without disrupting operation of the dishwasher 1, so that an essentially identical fill level of wash fluid S is established automatically in both chambers 47, 48. If for example wash fluid is removed from the circulation chamber 48 by way of the connector 43 of the circulation chamber 48, so that the fill level of wash fluid S in the circulation chamber 48 drops, the force of its own weight causes wash fluid S to flow from the collection chamber 47 through the screen arrangement 40, 45 into the circulation chamber 48, so that the fill levels in the circulation chamber 48 and the collection chamber 47 are equalized. Conversely, if for example wash fluid S is removed from the collection chamber 47 by way of the connector 42 of the collection chamber 47, wash fluid S flows from the circulation chamber 48 through the screen arrangement 40, 45 into the collection chamber 47. Such an arrangement of the circulation chamber 48 and the collection chamber 47, in which fill levels are equalized by the force of weight, is also referred to as a communicating arrangement.

The circulation chamber 48 is connected directly by way of a further fine screen 49, which is configured as essentially flat, to the wash chamber 7 disposed above the screen system 25. The flat fine screen 49 allows the already addressed first sub-flow AS1 of the evacuation flow AS to penetrate into the collection pot 21. The flat fine screen 49 here has through openings 50 that are such that dirt is prevented from penetrating into the circulation chamber 48.

The flat fine screen 49 also allows a second sub-flow US2 of the circulation flow US to be guided directly out of the wash chamber into the circulation chamber 48. The penetration of dirt into the circulation chamber 48 is prevented here too. Because only a first sub-flow US1 of the circulation flow US is guided through the fine screen cylinder 40 and the micro-screen cylinder 45, a large circulation flow US can be generated, which influences the cleaning action of the dishwasher 1 in a favorable manner.

To prevent the penetration of objects into the collection chamber 47, said objects not being able to be evacuated because of their size, a coarse screen 51 is provided, which has an upper segment 52 and a lower segment 53. The coarse screen 51 here is configured as an upright cylinder. Its upper segment 52 projects into the wash chamber 7 of the dishwasher 1, so that larger objects, which are washed from the side by wash fluid S, are retained on its outer face. Objects that drop directly from above into the interior of the coarse screen cylinder 51 are caught by ribs 54 that overlap in a plan view. They are then present in the collection chamber 47 but are prevented by the structure of the coarse screen cylinder 51 from moving with the first sub-flow US1 of the circulation flow US in the direction of the fine screen 40 or with a second sub-flow AS2 of the evacuation flow AS in the direction of the drain pump 28.

If the screen arrangement 40, 45 formed by the fine screen cylinder 40 and the micro-screen cylinder 45 is blocked, the first sub-flow US1 of the circulation flow US and the first sub-flow AS1 of the evacuation flow AS are interrupted or at least seriously obstructed. Interruption of the first sub-flow US1 of the circulation flow US means that the wash fluid S is not longer adequately cleaned of micro-particles of dirt, so the wash result may be unsatisfactory. An interruption of the first sub-flow AS1 of the evacuation flow AS also means that during an evacuation phase the wash fluid S can no longer be discharged completely to the outside. Instead a distribution of the wash fluid S' then results in the screen system 25, as indicated by the reference character S', with which a not inconsiderable quantity of wash fluid S' remains in the circulation chamber after evacuation. This remaining quantity of wash fluid S' is generally soiled and has a further adverse effect on the cleaning result of the wash cycle just performed and/or subsequent wash cycles.

In order now to be able to detect a blockage of the screen arrangement 40, 45, a detection sequence is provided, in which the turbidity sensor 26 is used. The turbidity sensor 26 generally comprises a light source, for example a light-emitting diode, and a light receiver, for example a phototransistor, which are disposed in such a manner that light emitted by the light-emitting diode passes through the medium present at the time in the circulation chamber 48, in other words generally wash fluid S or air, before striking the light receiver. The turbidity sensor 26 here is configured to determine the degree of transmission of the medium, in other words to determine the ratio of the intensity of the received light to the intensity of the emitted light, the intensity being the power of the light per unit of area.

Provision is made here for an evaluation of a number of values of the degree of turbidity determined by the turbidity sensor 26, from which it can be ascertained whether wash fluid S' is still present in the circulation chamber 48 after evacuation of the wash fluid S, as is characteristic of a blocked screen arrangement 40, 45.

Figure 4:
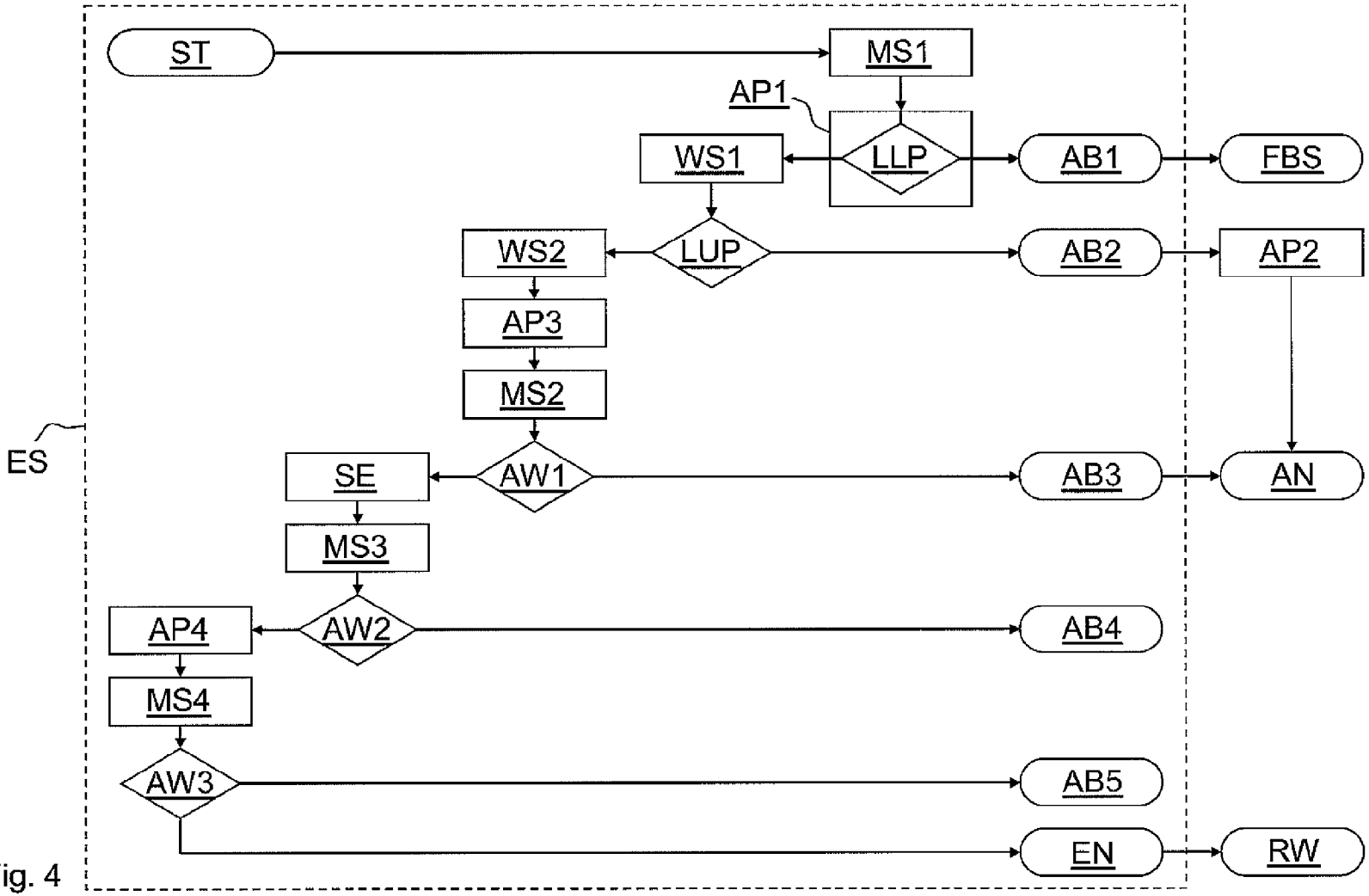
FIG. 4 shows a flow diagram of a detection sequence for detecting a blockage in the region of the screen system of the inventive dishwasher in FIGS. 1 to 3.

FIG. 4 shows a flow diagram of a detection sequence for detecting a blockage in the region of the screen system of the inventive dishwasher in FIGS. 1 to 3.

The inventive detection sequence ES for detecting a blockage of the screen arrangement 40, 45 can be performed for example at the end of a water-conducting wash subcycle. After the start ST of the detection sequence ES, when the circulation chamber 48 is full of wash fluid S, a first measuring step MS1 is performed, in which the optical turbidity sensor 26 is used to determine a degree of transmission in the circulation chamber 48.

Provision is also made in the context of the detection sequence ES after the first measuring step MS1 for a first evacuation step AP1 for evacuating the wash fluid S by way of the connector 42 of the collection chamber 47. If there is no blockage of the screen arrangement 40, 45, this also causes the wash fluid S present in the circulation chamber 48 to be evacuated, so that after the first evacuation step AP1 the circulation chamber 48 is essentially full of air. However if a blockage is present, at least some of said wash fluid S remains in the circulation chamber 48.

The first evacuation step AP1 advantageously comprises a load detection step LLP for determining a power consumption of the drain pump 28, with termination AB1 of the detection sequence taking place, if the power consumption is greater than a threshold value provided for the drain pump 28. Termination AB1 of the detection sequence ES here refers to an ending of the same, when a blockage of the screen arrangement 40, 45 is deemed to be excluded. If a suitably defined threshold value is now exceeded, this indicates that there is still wash fluid S present in the collection chamber 47 after the end of the evacuation step AP1. The wash fluid S present in the circulation chamber 48 before the first evacuation step AP1 can then not be discharged even if the screen arrangement 40, 45 is clear, so that incorrect detection of a blockage would occur if the detection sequence ES continued. This can be prevented by termination AB1 of the detection sequence ES.

After termination AB1 of the detection sequence ES an error processing sequence FBS for processing a malfunction of a discharge facility 29 disposed downstream of the drain pump 28 can be provided. If there is still wash fluid S present in the collection chamber 47 after the first evacuation step APE this is generally due to a malfunction of a discharge facility 29 assigned to the drain pump. By initiating a corresponding error processing sequence FBS it is now possible to prevent the malfunction remaining undetected. In particular the error processing sequence can comprise the outputting of a warning message to an operator by way of the output facility 4.

After the first evacuation step AP1 a load detection step LUP for determining a power consumption of the circulation pump 22 is expediently provided, with termination AB2 of the detection sequence ES taking place, if the power consumption is lower than a threshold value provided for the circulation pump 22. A power consumption below a suitably defined threshold value indicates with high probability that the circulation chamber 48 has been adequately emptied after the first evacuation step AP1, so it can be concluded that the filter arrangement is clear. Termination AB2 of the detection sequence simplifies the progress of the wash cycle without impacting on the reliability of blockage detection. If the defined threshold value is exceeded, even though the fill level is not too high and there is no blockage present, this is detected in the following first evaluation step AW1, so that incorrect detection of a blockage is excluded.

A first waiting step WS1 can be provided between the first evacuation step AP1 and the load detection step LUP for determining the power consumption of the circulation pump 22. This prevents incorrect determination of the power consumption of the circulation pump 22 due to transient phenomena, further improving detection reliability.

If, during the load detection step for determining the power consumption of the circulation pump 22, termination AB2 of the detection sequence ES takes place, after the load detection step LUP for determining the power consumption of the circulation pump 22 an adjustment step AN can be provided for redetermining the threshold value provided for the circulation pump 22, in which the power consumption of the circulation pump 22 is measured and a new threshold value is determined from the measured power consumption. In this instance the power consumption of the circulation pump 22 is measured when the circulation chamber is empty. This allows a change in the power consumption of the circulation pump when running dry, in other words when it is not conveying wash fluid, as caused by ageing phenomena, to be taken into account when the detection sequence ES is performed later.

A second evacuation step AP2 for evacuating the wash fluid S by way of the connector 42 of the collection chamber 47 is advantageously provided between the load detection step LUP for determining the power consumption of the circulation pump 22 and the adjustment step AN. This prevents any falsification of the measurement of the power consumption of the circulation pump 22 when running dry due to residual water, thereby improving the accuracy of the new threshold value.

If in the load detection step LLP for determining the power consumption of the drain pump 28 and in the load detection step LUP for determining the power consumption of the circulation pump 22, the conditions for termination AB1 or AB2 are not met, after the first evacuation step AP1 a second measuring step MS2 for a new determination of the degree of transmission in the circulation chamber 48 is performed by means of the optical turbidity sensor 26. A first evaluation step AW1 that now follows for evaluating a change in the degree of transmission from the first measuring step MS1 to the second measuring step MS2 now allows a conclusion to be drawn as to whether sufficient wash fluid S has been evacuated from the circulation chamber 48 by the first evacuation step AP1, as the degree of transmission changes significantly during the transition of the metered medium from fluid S to air. This in turn allows a conclusion to be drawn as to whether or not the filter arrangement is blocked.

The evaluation can take place here in such a manner that, if a decrease in the degree of transmission of at least a first minimum value is present, provision is made for termination AB3 of the detection sequence ES. The degree of transmission is around 30% greater in clear wash fluid than in air. Also the degree of transmission in soiled wash fluid S is generally in a region between around 30% to 10% greater than in air, depending on the degree of soiling. If there is a decrease of a suitably defined minimum value, it can be reliably excluded that the decrease in the degree of transmission is due to additional sudden soiling of the wash fluid S. It is therefore then extremely likely that during the first evacuation step AP1 a transition has taken place from wash fluid S to air, which ultimately means that the filter arrangement 40, 45 is very certainly not blocked. Incorrect detection of blockages can thus be reliably avoided. For example a decrease of at least 10% can be provided as the first minimum value.

It is advantageous, if termination AB3 of the detection sequence ES takes place during the first evaluation step AW1, after the first evaluation step AW1 for an adjustment step AN for redetermining the threshold value provided for the circulation pump 22 to be provided, in which the power consumption of the circulation pump 22 is measured and a new threshold value is determined from the measured power consumption. The power consumption of the circulation pump is measured when the circulation is empty in this instance. This allows a change in the power consumption of the circulation pump 22 when running dry, in other words when it is not conveying wash fluid S, as caused by ageing phenomena, to be taken into account when the detection sequence ES is performed later. The threshold value can be redetermined by adding together the measured power consumption and a safety margin. It is also possible to multiply the measured power consumption by a safety factor.

A third evacuation step AP3 for evacuating the wash fluid S by way of the connector 42 of the collection chamber 47 is expediently provided between the load detection step LUP for determining the power consumption of the circulation pump 22 and the second measuring step MS2. This prevents any falsification of the measurement of the degree of transmission in the second measuring step MS2 due to residual water collecting during the load detection step LUP, thereby improving the accuracy of determination of the degree of transmission and therefore detection reliability.

A second waiting step WS2 can also expediently be provided between the load detection step LUP for determining the power consumption of the circulation pump 22 and the third evacuation step AP3. This in particular prevents any falsification of the determination of the degree of transmission in the second measuring step MS2 due to foam formation in the load detection step LUP, thereby further improving detection reliability.

It is advantageous, if the decrease in the degree of transmission determined in the first evaluation step AW1 is lower than the first minimum value, after the second measuring step MS2 for a wash fluid supplementing step SE to be provided, in which an additional quantity of wash fluid S is fed to the screen system 25, with a third measuring step MS3 for determining the degree of transmission in the circulation chamber 48 by means of the optical turbidity sensor 26 being provided after the wash fluid supplementing step SE, with a second evaluation step AW2 for evaluating a change in the degree of transmission from the second measuring step MS2 to the third measuring step MS3 being provided, with termination AB4 of the detection sequence ES taking place, if an increase in the degree of transmission of at least a second minimum value is present.

If the decrease in the degree of transmission determined in the first evaluation step AW1 is lower than the first minimum value, this may be because either the wash fluid S has not drained out of the circulation chamber 48 during the first and third evacuation steps, which would be interpreted as a blockage of the screen arrangement 40, 45, or the wash fluid S was so soiled during the first measuring step MS1 that, because of its low degree of transmission, the first minimum value, in other words the minimum decrease from the first measured degree of transmission to the second measured degree of transmission, is not reached, despite a transition from wash fluid S to air, which would be interpreted as an absence of blockage.

In order to distinguish between these two instances, an additional quantity of the clearest wash fluid possible S is fed to the screen system 25. Intake water ZW can be fed in for this purpose for example by way of the intake valve 18. A third measuring step MS3 for determining the degree of transmission is now performed and the degree of transmission measured in this process is compared with the degree of transmission of the second measuring step MS2. If a minimum increase of for example 10% results, it can be concluded that there was no wash fluid present in the circulation chamber in the second measuring step MS2, clearly indicating that the screen arrangement 40, 45 is not blocked. Provision can then be made for termination AB4 of the detection sequence ES.

If the increase in the degree of transmission determined in the second evaluation step AW2 is lower than the second minimum value, after the second evaluation step AW2 a fourth evacuation step AP4 for evacuating the wash fluid S by way of the connector 42 of the collection chamber 47 is provided, with a fourth measuring step MS4 for determining the degree of transmission in the circulation chamber 48 by means of the optical turbidity sensor 26 being provided after the fourth evacuation step AP4 and with a third evaluation step AW3 for evaluating a change in the degree of transmission from the third measuring step MS3 to the fourth measuring step MS4 being provided, with termination AB5 of the detection sequence ES taking place, if a decrease in the degree of transmission of at least a third minimum value is present.

If the increase in the degree of transmission determined in the second evaluation step AW2 is lower than the second minimum value, this may be because either the wash fluid S has not drained out of the circulation chamber 48 during the first and third evacuation steps, which would be interpreted as a blockage of the screen arrangement 40, 45, or the wash fluid fed in during the wash fluid supplementing step SE was so soiled that, because of its low degree of transmission, the second minimum value, in other words the minimum increase from the second measured degree of transmission to the third measured degree of transmission is not reached, despite a transition from air to wash fluid S, which would be interpreted as an absence of blockage. In order to distinguish between these two instances a fourth evacuation step AP4 and a fourth measuring step MS4 for determining the degree of transmission are performed. The decrease from the third degree of transmission to the fourth degree of transmission is then determined. This result may be different from the result of the first evaluation step AW1, since at the start of the third measuring step MS3 clearer wash fluid S is generally present in the circulation chamber 48 than in the first measuring step MS1, due to the wash fluid supplementing step SE, so the decrease in the degree of transmission during the transition from wash fluid to air is more marked. If a minimum decrease of for example 7% now results, it can be concluded that no wash fluid S was present in the circulation chamber 48 in the fourth measuring step MS4, which clearly indicates that the screen arrangement 40, 45 is not blocked. Termination AB5 of the detection sequence can then be performed.

A decrease in the degree of transmission of less than the third minimum value is advantageously interpreted as a blockage in the third evaluation step AW3, so the end EN of the detection sequence is reached. When a blockage of the screen arrangement 40, 45 is detected in this manner, incorrect detection is pretty much excluded. It is advantageous here if an automatic sequence RW for eliminating the blockage and/or outputting a warning message is provided.

In one exemplary embodiment of the invention the aqua sensor 26 is automatically calibrated in the medium water S with a first measuring step MS1 to a first gradient before the sump 20 is emptied. Once the evacuation process AP1 has been successfully completed (identified as empty by the drain pump 28), a gradient G2 is determined in a second measuring step MS2 by means of a turbidity measurement.

The different absorption levels of the mediums water S and air (approx. 30%) mean that it is possible to determine from a comparison of the two gradients whether water S is still present in the outer region of the sump. This water could not be evacuated because of a soiled micro-screen.

The following measures could then be applied:

termination of the wash program and display "Clean screen" (or faucet LED)

specific routine for cleaning screen.

LIST OF REFERENCE CHARACTERS

1 Dishwasher
2 Control facility
3 Operating facility
4 Output facility
5 Wash container
6 Door
7 Wash chamber

8 Housing
9 Upper rack
10 Lower rack
11 Pull-out rail
12 Pull-out rail
13 Water intake facility
14 Connecting piece
15 Connecting hose
16 Connecting piece fixed to housing
17 Supply means, supply line
18 Intake valve
19 Fluid inlet
20 Base of wash container
21 Collection facility, collection pot
22 Circulation pump
23 Upper spray arm
24 Lower spray arm
25 Screen system
26 Turbidity sensor
27 Dosing facility
28 Drain pump
29 Discharge facility
30 Connecting line
31 Connector fixed to housing
32 Waste water hose
33 Connecting piece
34 Signal line
35 Signal line
36 Control line
37 Supply line
38 Supply line
39 Signal line
40 Cylindrical fine screen
41 Base of collection pot
42 Connector for drain pump
43 Connector for circulation pump
44 Through openings of cylindrical fine screen
45 Cylindrical micro-screen
46 Through openings of cylindrical micro-screen
47 Collection chamber
48 Circulation chamber
49 Flat fine screen
50 Through openings of flat fine screen
51 Coarse screen
52 Upper segment
53 Lower segment
54 Ribs
WH Water supply facility, faucet
ZW Intake water
S Wash fluid
AR Waste water disposal facility, waste water pipe
AW Waste water
ES Detection sequence
ST Start
MS1 First measuring step
AP1 First evacuation step
LLP Load detection step at drain pump
AB1 Termination
FBS Error processing sequence
WS1 First waiting step
LUP Load detection step at circulation pump
AB2 Termination
AP2 Second evacuation step
AN Adjustment step
WS2 Second waiting step
AP3 Third evacuation step
MS2 Second measuring step
AW1 First evaluation step
AB3 Termination
SE Wash fluid supplementing step
MS3 Third measuring step
AW2 Second evaluation step
AB4 Termination
AP4 Fourth evacuation step
MS4 Fourth measuring step
AW3 Third evaluation step
AB5 Termination
EN End of detection sequence
RW Cleaning sequence and/or warning message

The invention claimed is:

1. A dishwasher comprising:

a control facility for performing a wash cycle for cleaning items to be washed, a screen system for filtering a wash fluid, said screen system having a circulation chamber and a collection chamber that is in communication with the circulation chamber via a screen arrangement through which the wash fluid flows, a circulation pump for circulating the wash fluid, a circulation chamber connector disposed on the circulation chamber for the circulation pump, a drain pump for pumping the wash fluid out, and a collection chamber connector disposed on the collection chamber for the drain pump, wherein the control facility is configured to perform at least one detection sequence for detecting a blockage of the screen arrangement, said at least one detection sequence comprising:

a first measuring step for determining with an optical turbidity sensor a degree of transmission in the circulation chamber filled with wash fluid, a first pumping step for pumping the wash fluid out through the collection chamber connector, a second measuring step for determining with the optical turbidity sensor the degree of transmission in the circulation chamber, and a first evaluation step for evaluating a change in the degree of transmission from the first measuring step to the second measuring step, wherein the control facility is configured to determine that wash fluid is not present in the circulation chamber and that a blockage of the screen arrangement is not present, if the degree of transmission from the first measuring step to the second measuring step decreases by at least a first minimum value, and wherein the control facility is configured to terminate the at least one detection sequence in response to a determination that wash fluid is not present in the circulation chamber and that a blockage of the screen arrangement is not present.

2. The dishwasher of claim 1, wherein the dishwasher is a household dishwasher.

3. The dishwasher of claim 1, wherein the first pumping step comprises a load detection step for determining power consumption of the drain pump, wherein the at least one detection sequence is terminated when the power consumption of the drain pump is greater than a drain pump threshold value.

4. The dishwasher of claim 3, further comprising a discharge facility disposed downstream of the drain pump, wherein if the at least one detection sequence is terminated during the load detection step, an error processing sequence for processing a malfunction of the discharge facility is performed.

5. The dishwasher of claim 1, wherein a load detection step for determining power consumption of the circulation pump is performed between the first pumping step and the second measuring step, wherein the at least one detection sequence is terminated, if the power consumption of the circulation pump is lower than a circulation pump threshold value.

6. The dishwasher of claim 5, wherein the power consumption of the circulation pump is determined in a first waiting step arranged between the first pumping step and the load detection step.

7. The dishwasher of claim 5, wherein, if the at least one detection sequence is terminated during the load detection step, an adjustment step redefining the circulation pump threshold value is performed, wherein the adjustment step includes measuring the power consumption of the circulation pump and determining a new threshold value from the measured power consumption.

8. The dishwasher of claim 7, wherein a second pumping step is performed between the load detection step and the adjustment step, and the wash fluid is pumped out during the second pumping step through the collection chamber connector.

9. The dishwasher of claim 5, wherein a third pumping step is performed between the load detection step and the second measuring step, and the wash fluid is pumped out during the third pumping step through the collection chamber connector.

10. The dishwasher of claim 9, wherein a second waiting step is performed between the load detection step and the third pumping step.

11. The dishwasher of claim 5, wherein, if the at least one detection sequence is terminated during the first evaluation step, an adjustment step for redefining the circulation pump threshold value is performed after the first evaluation step, wherein power consumption of the circulation pump is measured and a new circulation pump threshold value is determined from the measured power consumption.

12. The dishwasher of claim 1, wherein, if a decrease in the degree of transmission determined in the first evaluation step is less than the first minimum value, a wash fluid supplementing step is performed after the second measuring step, in which wash fluid supplementing step an additional quantity of wash fluid is fed to the screen system, wherein a third measuring step for determining with the optical turbidity sensor the degree of transmission in the circulation chamber is performed after the wash fluid supplementing step, wherein a second evaluation step for evaluating a change in the degree of transmission from the second measuring step to the third measuring step is performed, wherein the at least one detection sequence is terminated, if the degree of transmission increases from the second to the third measuring step by at least a second minimum value.

13. The dishwasher of claim 12, wherein, if the increase in the degree of transmission determined in the second evaluation step is lower than the second minimum value, a fourth pumping step for pumping out the wash fluid through the connector of the collection chamber is performed after the second evaluation step, a fourth measuring step for determining with the optical turbidity sensor the degree of transmission in the circulation chamber is performed after the fourth pumping step, and a third evaluation step for evaluating a change in the degree of transmission from the third measuring step to the fourth measuring step is performed, wherein the at least one detection sequence is terminated, when the degree of transmission decreases by at least a third minimum value.

14. The dishwasher of claim 13, wherein a decrease in the degree of transmission by less than the third minimum value in the third evaluation step is interpreted as a blockage of the screen arrangement and the control facility initiates an automatic sequence for eliminating the blockage or outputting a warning message, or both.

15. The dishwasher of claim 1, wherein the screen arrangement further comprises a fine screen and a micro screen.

16. The dishwasher of claim 15, wherein the fine screen and the micro screen are cylindrical and concentric.

17. The dishwasher of claim 1, wherein the control facility is configured to determine power consumption of the circulation pump, wherein the at least one detection sequence is terminated, if the power consumption of the circulation pump is lower than a circulation pump threshold value.

18. A method for operating a dishwasher having a control facility for performing a wash cycle for cleaning items to be washed, a screen system for filtering a wash fluid, the screen system having a circulation chamber and a collection chamber in communication with the circulation chamber by way of a screen arrangement through which the wash fluid can flow, a circulation chamber connector disposed on the circulation chamber for a circulation pump for circulating the wash fluid and a collection chamber connector disposed on the collection chamber for a drain pump for pumping out the wash fluid, wherein during the wash cycle the control facility performs at least one detection sequence for detecting a blockage of the screen arrangement, said at least one detection sequence comprising:

determining in a first measuring step with an optical turbidity sensor a degree of transmission in the circulation chamber filled with wash fluid, pumping out the wash fluid through the collection chamber connector, determining in a second measuring step with the optical turbidity sensor the degree of transmission in the circulation chamber, evaluating a change in the degree of transmission from the first measuring step to the second measuring step with the control facility, determining that wash fluid is not present in the circulation chamber and that a blockage of the screen arrangement is not present, if the degree of transmission evaluated with the control facility from the first measuring step to the second measuring step decreases by at least a first minimum value, and terminating the at least one detection sequence with the control facility in response to a determination that wash fluid is not present in the circulation chamber and that a blockage of the screen arrangement is not present.

19. The method of claim 18, wherein pumping out the wash fluid through the collection chamber connector further comprises determining power consumption of the drain pump with the control facility, and wherein the method further comprises terminating the at least one detection sequence with the control facility, if the power consumption of the drain pump is greater than a drain pump threshold value.

20. The method of claim 18, further comprising:

determining power consumption of the circulation pump with the control facility between the first pumping step and the second measuring step; and terminating the at least one detection sequence with the control facility, if the power consumption of the circulation pump is lower than a circulation pump threshold value.

21. A water-hearing domestic appliance comprising:

a control facility;

a screen system for filtering wash fluid, said screen system having the circulation chamber and a collection chamber that is in communication with the circulation chamber via a screen arrangement through which the wash fluid flows;

a circulation chamber;

a circulation pump for circulating the wash fluid;

a circulation chamber connector disposed on the circulation chamber for the circulation pump;

a drain pump for pumping the wash fluid out; and a collection chamber connector disposed on the collection chamber for the drain pump, and an optical turbidity sensor in the circulation chamber, wherein the control facility is configured to perform at least one detection sequence to determine whether said circulation chamber contains wash fluid, said at least one detection sequence comprising:

measuring a degree of transmission in the circulation chamber detected by the optical turbidity sensor over time, if the degree of transmission detected by the optical turbidity sensor decreases over time by at least a predetermined value, determining that wash fluid is not present in the circulation chamber, and terminating the at least one detection sequence if the control facility determines that wash fluid is not present in the circulation chamber, wherein the control facility is configured to determine power consumption of the drain pump, wherein the at least one detection sequence is terminated when the power consumption of the drain pump is greater than a drain pump threshold value.

* * * * *